United States Patent [19]

Tanaka

[11] 4,084,345

[45] Apr. 18, 1978

[54] TOY HELICOPTER

[75] Inventor: Yutaka Tanaka, Urawa, Japan

[73] Assignee: Toytown Corporation, Tokyo, Japan

[21] Appl. No.: 809,682

[22] Filed: Jun. 24, 1977

[51] Int. Cl.[2] ..... A63H 27/12

[52] U.S. Cl. ..... 46/75; 46/82

[58] Field of Search ..... 46/75, 82

[56] References Cited

U.S. PATENT DOCUMENTS

| | | | |
|---|---|---|---|
| 1,803,636 | 5/1931 | Nelson | 46/82 |
| 2,138,168 | 11/1938 | Horak | 46/75 |
| 2,418,269 | 4/1947 | Lewis | 46/75 |
| 2,439,143 | 4/1948 | Nemeth | 46/75 |
| 2,469,144 | 5/1949 | Baggott | 46/75 |

FOREIGN PATENT DOCUMENTS

| | | | |
|---|---|---|---|
| 492,899 | 4/1951 | Italy | 46/75 |
| 617,386 | 2/1949 | United Kingdom | 46/75 |

*Primary Examiner*—Louis G. Mancene
*Assistant Examiner*—Mickey Yu
*Attorney, Agent, or Firm*—Staas & Halsey

[57] ABSTRACT

A toy helicopter including a body, a frame mounted to rotate with respect to said body, a spindle extending through an opening provided in the frame and mounted to rotate with respect to the frame, an energy storing mechanism operatively connecting the spindle and frame, a first wing operatively connected to the spindle to rotate therewith, and a second wing operatively connected to the frame to rotate therewith.

1 Claim, 4 Drawing Figures

FIG. 3.
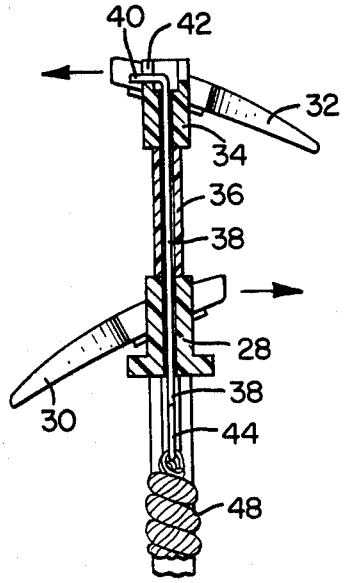
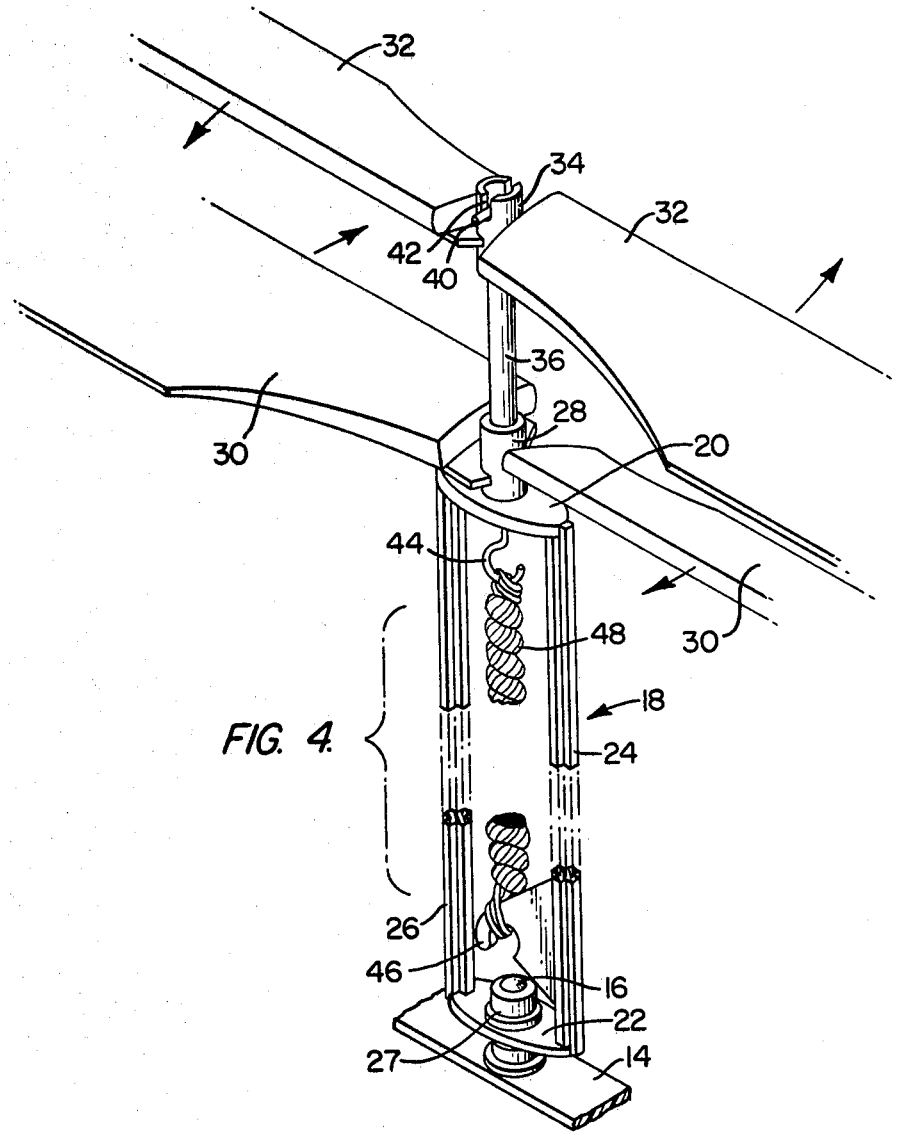
FIG. 4.

TOY HELICOPTER

BACKGROUND AND SUMMARY OF INVENTION

The present invention relates to the general class of flying toys, and more particularly to a toy helicopter wherein the winding of a first blade thereof stores energy in a resilient band, after which the release of the energy stored therein causes the first blade to rotate in one direction and a second blade to rotate in the opposite direction propelling the helicopter. The foregoing is accomplished with the use of a frame to which one of the blades is fixedly secured and which is mounted for rotation with respect to the helicopter, a spindle to which the other blade is fixedly secured and which is mounted for rotation with respect to the frame, and a resilient, energy storing band connected to the frame and spindle.

BRIEF DESCRIPTION OF THE DRAWINGS

FIG. 3 is an enlarged cross-sectional view of the hubs to which the blades are mounted, the cylindrical housing positioned therebetween, and the spindle which passes through longitudinal openings in the hubs and housing; and FIG. 4 is an enlarged perspective view of the frame, the rubberband which is secured at one end to an abutment on the frame and at the other end to a hook formed at the lower end of the spindle, and the hub to which the upper blade is mounted which is provided with a channel through which the bent upper end of the spindle extends ensuring that the spindle and the upper blade rotate as a single entity.

DESCRIPTION OF THE PREFERRED EMBODIMENT

Figure 1:
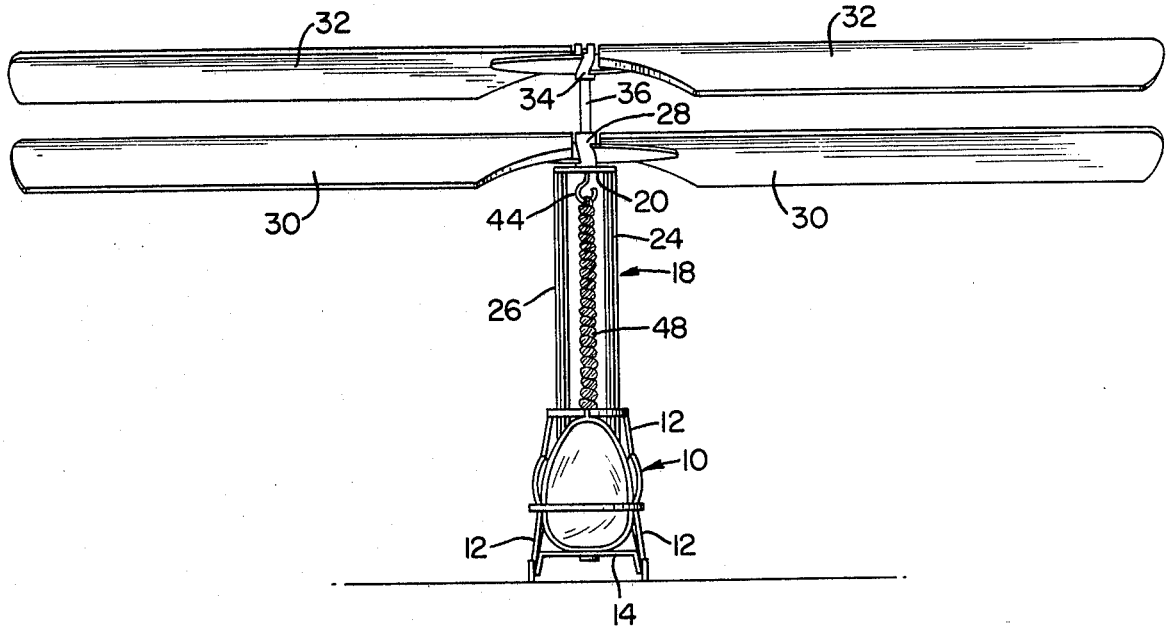
FIG. 1 is a front elevational view of the toy helicopter illustrating the rectangular frame which is rotatably mounted to the body and the upper and lower blades, the latter being fixedly secured to the top of the frame.

The toy helicopter, as illustrated in FIG. 1, consists of a body designated generally by the reference numeral 10 which is defined by a plurality of interconnected stringers 12. There is provided at the bottom of the body 10 a platform 14 having a shaft 16 extending upwardly therefrom, as seen in FIG. 4. A frame, generally designated by reference numeral 18 and consisting of top, bottom and side members 20, 22, 24 and 26, respectively, is mounted to rotate with respect to the body 10 as a result of the shaft 16 passing through openings provided in the bottom member 22 and the hubs 27 located on each side thereof. Extending upwardly from the top member 20 and formed as an integral part thereof is a hub 28 to which the sections of the lower blade 30 are attached. With reference to FIG. 3, it will be apparent that the sections of the upper blade 32 are attached to a hub 34, and that a cylindrical housing 36 is positioned between the hubs 28 and 34. The hubs 28 and 34 and the housing 36 are provided with openings through which a spindle 38 passes, as illustrated in FIG. 3. The top 40 of the spindle 38 is bent and extends outwardly through a channel 42 at the top of the hub 34 thus locking the spindle 38 while an abutment 46 extends outwardly from the side member 24 near the bottom thereof. In this manner it is possible to connect the hook 44 which is formed at the end of the spindle 38 and the abutment 46 with an energy storing mechanism, for example, the rubberband 48 illustrated in FIG. 4.

Figure 2:
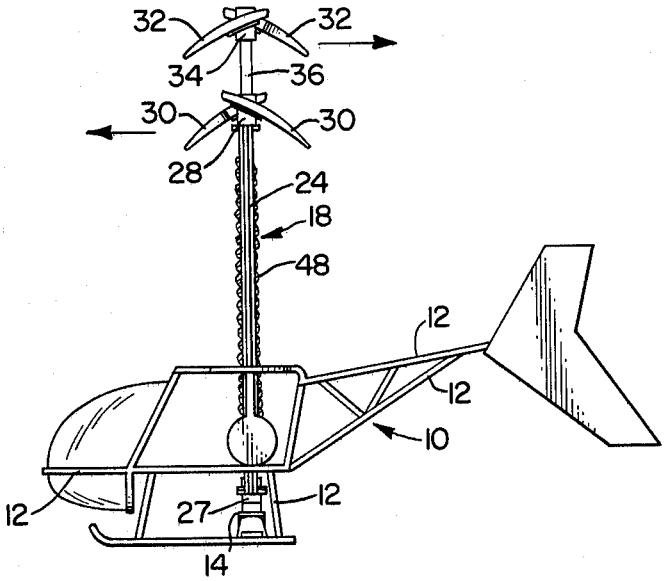
FIG. 2 is a side elevational view illustrating the platform which connects the sides of the body and to which the frame is rotatably mounted, and the angular relationship of the segments of the upper and lower blades.

From the foregoing, it will be apparent that when the frame 18 is held stationary and the upper blade 32 is rotated, the spindle 38 rotates thus winding up the rubberband 48. When the toy helicopter is thereafter released, the upper blade 32 is caused to rotate in a direction opposite to the direction that it was manually rotated during the winding of the rubberband 48, while the lower blade 30, which remains stationary when the upper blade 32 is being rotated to wind the rubberband 48 because of its rigid connection to the frame 18, is caused to rotate with the frame 18 in a direction opposite to the direction of rotation of the upper blade 32. That is, the energy released by the unwinding of the rubberband 48 acts to rotate the spindle 38 and upper blade 32 attached thereto in one direction, and the frame 18, which is mounted to rotate about the shaft 16 extending upwardly from the platform 14 and the lower blade 30 attached thereto, is rotated in the opposite direction. It will be apparent from FIGS. 2 and 3 that the pitch (the angle of the air foil) of the upper and lower blades 32 and 30 is reversed to permit the oppositely rotating blades 30 and 32 to each provide the necessary lift force to permit the toy helicopter to fly in a very realistic manner.

I claim:

1. A toy helicopter, comprising:

a body provided with a supporting member in the vicinity of the bottom thereof, a shaft extending upwardly from said supporting member, and an opening at the top of said body which is generally circular in cross-section, a generally rectangular frame having top, bottom and side connecting members, said bottom member having an opening therein through which said shaft of said body extends while said side members are spaced apart from each other a distance permitting said frame to rotate about said shaft and within said opening in said body, said top member having an opening therein, and a hook provided on one of said side members in the vicinity of the bottom thereof, a wire spindle extending through said opening in said top member and provided with a hook at the lower end thereof, a first hub fixedly secured to said top member of said frame and provided with an opening therein through which said spindle extends, a cylindrical housing positioned on top of said first hub and provided with an opening extending longitudinally therethrough through which said spindle extends, and a second hub positioned on top of said cylindrical housing and provided with an opening through which said spindle passes, the top of said spindle being fixedly secured to said second hub, such that said second hub rotates with said spindle, a resilient band connecting said hook of said spindle and said hook provided on said side member, a first wing operatively connected to said first hub to rotate with said first hub and frame, and a second wing operatively connected to said second hub to rotate therewith, the pitch of said first and second wings being reversed.

* * * * *